United States Patent [19]

Larson et al.

[11] 4,396,128

[45] Aug. 2, 1983

[54] BAIL STRUCTURE

[75] Inventors: Curtis L. Larson, Hudson, Wis.; Dee L. Johnson, Woodbury, Minn.

[73] Assignee: Minnesota Mining and Manufacturing Company, St. Paul, Minn.

[21] Appl. No.: 341,903

[22] Filed: Jan. 22, 1982

[51] Int. Cl.[3] ..... B65D 23/10

[52] U.S. Cl. ..... 215/100 A; 220/94 R; 248/318; 294/31.2

[58] Field of Search ..... 215/100 A; 220/94 R; 294/31.2, 149; 248/318, 359

[56] References Cited

U.S. PATENT DOCUMENTS 3,623,633 11/1971 Kinn ..... 220/94 R 3,717,277 2/1973 Stengle ..... 215/100 A 4,022,416 5/1977 Kaye ..... 248/318

*Primary Examiner*—Donald F. Norton

*Attorney, Agent, or Firm*—Cruzan Alexander; Donald M. Sell; William L. Huebsch

[57] ABSTRACT

A bail structure comprising an elongate polymeric strip including a handle portion, and two end anchor portions adapted to be adhered to opposite sides of a container. Each of the anchor portions includes a first part projecting away from the handle portion and a second part projecting at a right angle away from the adjacent end of the handle portion. The handle portion can be moved from a storage position adjacent an end of a container on which the anchor portions are adhered, to a use position extending across the end of the container, at which use position the handle portion may be used to suspend the container.

16 Claims, 12 Drawing Figures

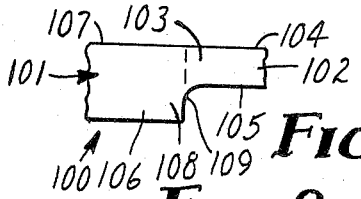
FIG. 12
FIG. 8
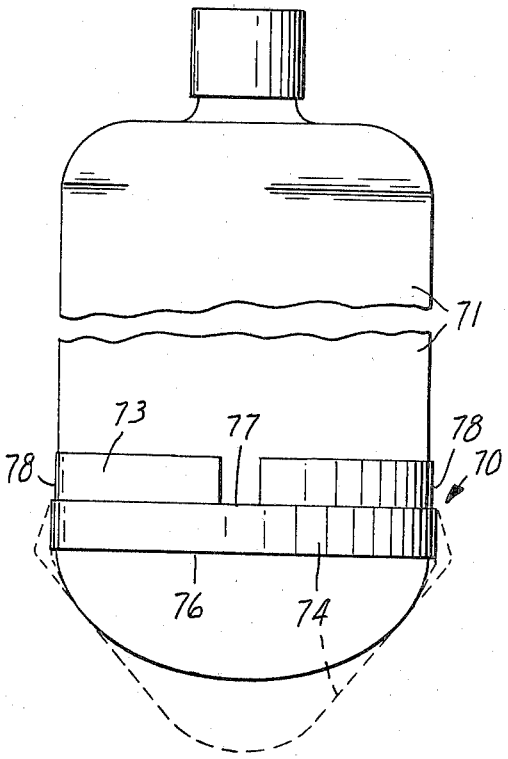
FIG. 7
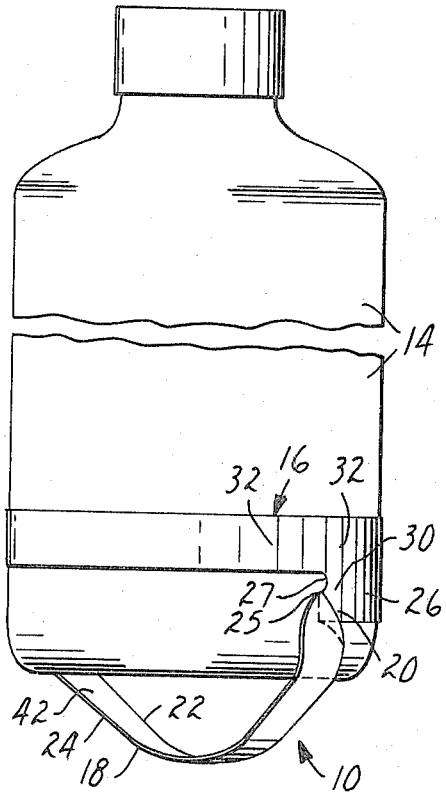
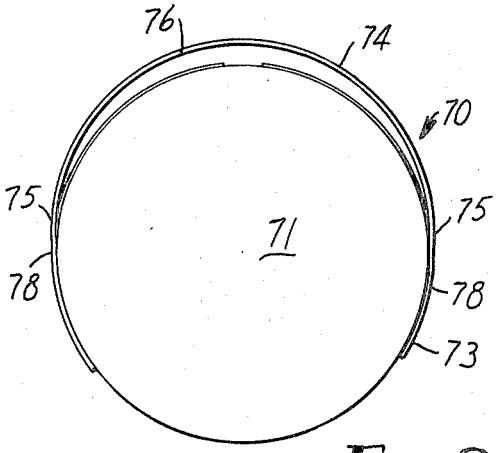
FIG. 9
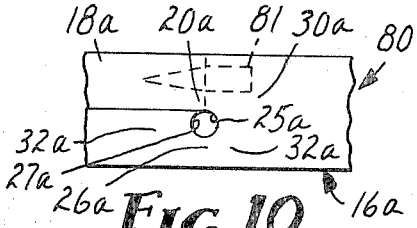
FIG. 10
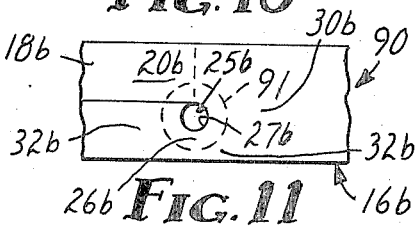
FIG. 11

BAIL STRUCTURE

TECHNICAL FIELD

The present invention relates to structures of flexible polymeric material that may be attached to containers to provide a bail or hanger for the container.

BACKGROUND ART

The art is replete with structures formed of flexible polymeric material that may be attached to a container to provide a bail or hanger for the container. U.S. Pat. Nos. 3,000,527; 3,045,070; 3,119,541; 3,220,591; 3,594,891; 3,623,633; 3,635,367; 3,653,610; 3,717,277; 3,744,658; 3,807,679; 4,022,416 provide typical examples.

Generally such prior art structures can provide some advantages over more conventional metal bail or hanger structures, which advantages may include ease of application, ease of labeling for the container to which they are attached, reduction or elimination of corrosion during storage, reduction or denting and scuffing of labels on containers packed together, and ease of color coding.

Many of such prior art structures, however, include circular molded portions adapted to encircle a container which are expensive and typically require close tolerances or are heat shrinkable to ensure that they will securely engage a container on which they are to be used. Also, many require specially shaped containers to ensure secure engagement between the container and assembly.

U.S. Pat. No. 3,623,633 describes a bail structure which is an elongate strip of flexible material having end anchor portions adapted to be adhered circumferentially around the periphery of a container ajacent one of its ends, and a central handle portion adapted to extend between generally opposite locations on the periphery of the container when the anchors are adhered to the container. The handle portion can then be moved from a normal storage position extending circumferentially around the periphery of the container in alignment with its end portions, to a use position extending at right angles to its end portions and extending across the end of the container, at which use position the central portion may be used to carry or suspend the container. While this elongate strip can be cut from sheet material and need not be molded or made to close tolerances, and can be applied without any substantial problems relating to the shape or tolerances of the container end, folds formed in the strip between its handle and anchor portions when its handle portion is moved to its use position tend to peel the adhesive attaching the anchor portions away from the container as tension is applied to the handle portion by supporting the weight of the container or otherwise, so that a special high shear adhesive is specified to restrict such peeling.

DISCLOSURE OF INVENTION

The present invention provides a bail assembly that, like the bail assembly described in U.S. Pat. No. 3,623,633, comprises an inexpensive, elongate, polymeric strip which can be cut from sheet material, and includes end anchor portions that can be easily bonded as by an adhesive to generally opposite sides of a container without any substantial problems relative to the shape of the container, and a central handle portion that then extends circumferentially around the side of the container in a storage position and can be moved to a use position across the end of a container; but which, unlike the bail assembly of U.S. Pat. No. 3,623,633, does not place the bond or adhesive between the anchor portions and a container in peel when stress is applied to the handle portion in its use position.

The bail structure according to the present invention comprises a tough, flexible, elongate polymeric strip comprising (1) the elongate handle portion having two opposite ends and first and second opposite edges extending between its opposite ends, with the second edge having arcuate end portions at the ends of the handle portion extending away from the first edge in a direction generally at right angles to the longitudinal direction of the handle portion; and (2) the two anchor portions adapted to be bonded as by an adhesive to a container, which anchor portions are integrally formed with the handle portion with one anchor portion at each of its opposite ends. Each of the anchor portions comprises contiguous first and second parts shaped so that, when the major surfaces of the handle and anchor portions are coplanar, (1) the first part projects away from the handle portion in a direction generally aligned with the handle portion; and (2) the second part projects away from the first part along and past the adjacent arcuate end portion of the second edge in a direction generally normal to the length of the handle portion; and preferably extends around the adjacent acruate end portion and along the second edge of the handle portion.

The anchor portions can be bonded on opposite sides of a container with the major surfaces of the strip generally parallel to an axis of the container and with the handle portion in a storage position adjacent an end of the container. The handle portion can then be moved to a use position extending across the end of the container at which use position the container may be suspended via the handle portion. When the container is thus suspended, the second part of the anchor portion resists the stresses that are applied in peel to the adhesive between the anchor portions and container in the structure described in U.S. Pat. No. 3,623,633; and instead of peel, applies these stresses in shear to the bond or adhesive between the anchor portions and the container. This is advantageous since most bonds or adhesives have more strength in shear than in peel.

Also, the arcuate end portions of the second edge (which arcuate end portions extend away from the first edge generally at right angles to the longitudinal direction of the handle portion when the major surfaces of the handle and anchor portions are coplanar) provide means for greatly restricting the effects of notch sensitivity at the ends of the second edge when the handle portion is in its use portion. Such notch sensitivity could otherwise facilitate tearing of the strip at the ends of the second edge and such tearing would result in the application of forces at the handle portion in peel to the bond or adhesive attaching the anchor portions to the container. With such arcuate end portions of the second edge, stresses between the handle portion and the anchor portions when the anchor portion is in its use position are directed generally parallel to the end portions of the second edge which are then somewhat straightened, so that there is little tendency for the second edge to promote tearing of the strip.

Suitable polymeric materials for the strip material should be tear resistant, need not be oriented in any direction but preferably orient themselves slightly upon stretching to improve their tear resistance at the ends of the second edge, may be solid, woven or nonwoven construction and are preferably somewhat stretchable so that they tend to absorb shock loads applied at the handle portion. Suitable materials include polyurethanes, polybutylene, polypropylenes, and modified polyethylene ionomers such as that sold under the trade designation "Surlyn" by Dupont. The thickness of the materials may vary depending on the weight and use of the container to which the bail assembly is attached, however materials having a thickness of about 12 mils appear suitable to support a gallon container filled with most materials.

The anchor portions may be bonded through the use of an adhesive or by any other suitable method which may include heat sealing or sonic welding if the container is of a suitable material.

The adhesives used for bonding the anchor portion may be any suitable thermoplastic or pressure-sensitive adhesive. When pressure-sensitive adhesives are used they may be adhered over one entire major surface of the strip material, and the adhesive on the handle portion of the bail structure may be detackified (e.g., by applying talcum powder) to prevent the handle portion from becoming adhered to a container, or may be covered by a cover sheet which both prevents the handle portion from becoming adhered to a container and thickens the handle portion so that it is more comfortable to grasp.

BRIEF DESCRIPTION OF THE DRAWING

The present invention will be further described with reference to the accompanying drawing wherein like numbers refer to like parts in the several views, and wherein:

FIG. 7 is a side view of the first embodiment of the bail structure of FIG. 1 shown adhered to a fragment of a container;

FIG. 8 is a side view of a fourth alternate embodiment of a bail structure according to the present invention shown adhered to a fragment of a container;

FIG. 9 is an end view of the bail structure and container combination shown in FIG. 8; and FIGS. 10, 11 and 12 are fragmentary views respectively of fifth, sixth and seventh alternate embodiments of bail structures according to the present invention.

DETAILED DESCRIPTION

Figure 2:
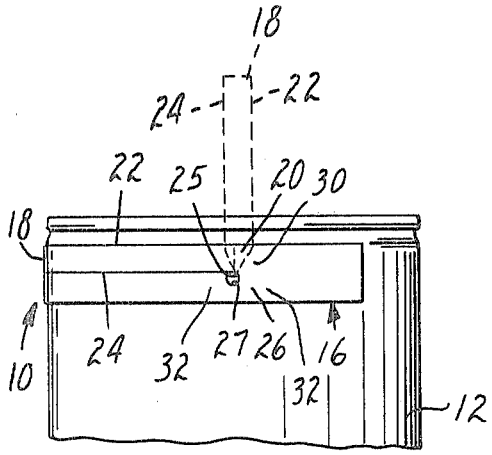
FIG. 2 is a side view of the bail structure of FIG. 1 shown adhered to a fragment of a container.
Figure 1:
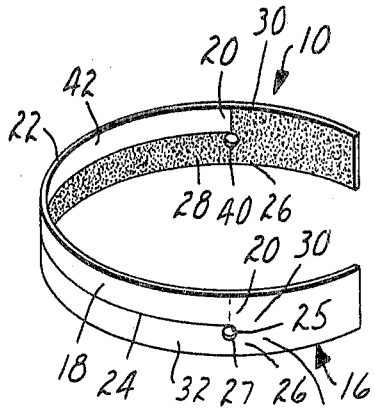
FIG. 1 is a perspective view of a first embodiment of a bail structure according to the present invention.
Figure 3:
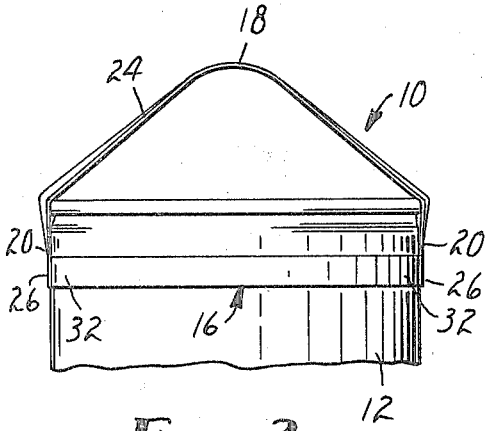
FIG. 3 is a left side view of the bail structure and container fragment combination as shown in FIG. 2.
Figure 4:
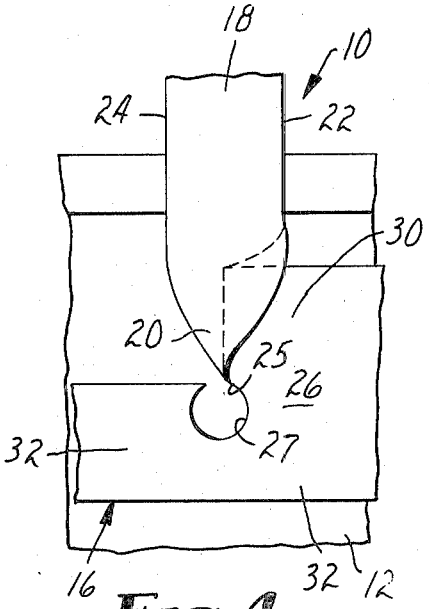
FIG. 4 is an enlarged fragmentary view of a portion of the bail structure and container fragment combination shown in FIG. 2.

Referring now to FIG. 1 of the drawing there is shown a first embodiment of a bail structure according to the present invention generally designated by the reference numeral 10; which bail structure 10 is shown attached to a container or pail 12 of the type generally used to hold paint in FIGS. 2, 3 and 4 and is shown in FIG. 7 attached to a container or bottle 14 of the type used to contain fluids adapted to be intraveneously introduced into a patient.

Generally, the bail structure 10 comprises a tough, flexible, elongate polymeric strip 16 including an elongate handle portion 18 having two opposite ends 20 and first and second opposite edges 22 and 24 resepctively extending between its opposite ends 20, with the second edge 24 having arcuate end portions 25 at the ends 20 of the handle portion 18 extending away from the first edge 22 in a direction generally at right angles to the longitudinal direction of the handle portion 18, which arcuate end portions 25 define about 90 degree arcs of generally circular openings through the strip at the juncture of the handle and anchor portions 18 and 26. Also included in the strip 16 are two anchor portions 26 adapted to be bonded or adhered via a thermoplastic or pressure-sensitive adhesive layer 28 on one major surface of the strip 16 to a container such as the pail 12 (FIGS. 2, 3 and 4) or the bottle 14 (FIG. 7). The anchor portions 26 are integrally formed with the handle portion 18 with one anchor portion 26 at each of its opposite ends 20. Each of the anchor portions 26 comprises first and second contiguous parts 30 and 32 shaped so that, when the major surfaces of the handle and anchor portion 18 and 26 are coplanar, the first part 30 projects away from the handle portion 18 in a direction generally aligned with the length of the handle portion 18; and the second part 32 projects away from the first part 30 along and past the adjacent arcuate end portion 25 of the second edge 24 in a direction generally normal to the length of the handle portion 18, and extends around the adjacent arcuate end portion 25 along the second edge 24 of the handle portion 18. The anchor portions 26 can be adhered on opposite sides of a container (e.g., pail 12 or bottle 14) via the adhesive layer 28 with the major surfaces of all portions of the strip 16 generally parallel to an axis of the container 12 or 14 and with the handle portion 18 in a storage position adjacent an end of the container 12 or 14 (solid lines in FIG. 2). Subsequently the handle portion 18 can be moved to a use position (dotted lines in FIG. 2 and solid lines in FIGS. 4 and 7) extending across the adjacent end of the container 12 or 14, at which use position the handle portion 18 may be used to suspend the container (e.g., used to manually carry the pail 12 or suspend the bottle 14 in an inverted position from a hanger).

The arcuate end portions 25 of the second edge 24 restrict tearing of the strip 16 at the second edge 24 when the container 12 or 14 is suspended by the handle portion 18. In the use position of the handle portion 18, the end portions 25 of the second edge 24 are somewhat straightened and extend generally axially along the container 12 or 14 and away from the handle portion 18 (FIGS. 4 and 7) so that the end portions 25 of the second edge 24 are then generally parallel with the forces applied through the handle portion 18 to suspend the container 12 or 14 and there is little tendency for a tear to be initiated in the anchor portions 26 by the second edge 24.

Also, the bail structure 10 includes a cover sheet 42 over the adhesive layer 28 on the handle portion 18 which both prevents the adhesive layer 28 from adhering the handle portion 18 to the side of the container 12 or 14, and thickens the handle portion 18 to provide a more comfortable grip for a person carrying the container by the handle portion 18.

Figure 5:
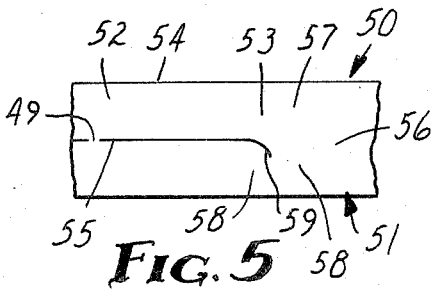
FIG. 5 is a fragmentary view of a second alternate embodiment of a bail structure according to the present invention.

Referring now to FIG. 5 there is shown a fragment of a second embodiment of a bail structure 50 according to the present invention which illustrates an alternative to forming openings 27 in the strip 16 to provide arcuate end portions for the second edge 24. Like the bail structure 10, the bail structure 50 comprises a tough, flexible, elongate polymeric strip 51 including an elongate handle portion 52 having two opposite ends 53 and first and second opposite edges 54 and 55 respectively extending between its opposite ends 53, with the second edge 55 having arcuate end portions 59 at the ends 53 of the handle portion 52 extending away from the first edge 54 in a direction generally at right angles to the longitudinal direction of the handle portion 52; and two anchor portions 56 adapted to be bonded as by adhesive to a container. The anchor portions 56 are integrally formed with the handle portion 52 with one anchor portion 56 at each of its opposite ends 53. Each of the anchor portions 56 comprises first and second contiguous parts 57 and 58 shaped so that, when the major surfaces of the handle and anchor portion 52 and 56 are coplanar, the first part 57 projects away from the handle portion 52 in a direction generally aligned with the handle portion 52, and the second part 58 projects away from the first part 57 along and past the adjacent arcuate end portion 59 of that second edge 55 in a direction generally normal to the length of the handle portion 52, and extends around the adjacent arcuate terminal end 59 and along the second edge 55 of the handle portion 52. The anchor portions 56 can be bonded on generally opposite sides of a container via an adhesive with the major surfaces of all portions of the strip 51 generally parallel to an axis of the container and with its handle portion 52 in a storage position adjacent an end of the container, and subsequently the handle portion 52 can be moved to a use position extending across the adjacent end of the container, at which use position the handle portion 52 may be used to suspend the container.

Also, as with the strip 16, the arcuate end portions 59 of the second edge 55 restrict tearing of the strip 51 at the second edge 55 when the container is suspended by the handle portion 52. In the use position of the handle portion 52, the end portions 59 of the second edge 55 are generally straightened and extend generally axially along the container and away from the handle portion 52, and are then generally parallel with the forces applied through the handle portion 52 to suspend the container so that there is little tendency for a tear to be initiated in the anchor portions 56 by the second edge 55. Additionally, the handle portion 52 of the bail structure 50 is attached to the anchor portion 56 at locations 59 that initially hold the handle portion 52 in its storage position until a user ruptures the locations 49 to move the handle portion 52 to use position.

Figure 6:
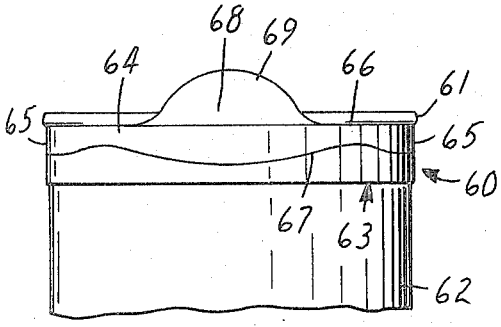
FIG. 6 is a side view of a third alternate embodiment of a bail structure according to the present invention shown adhered to a fragment of a container.

Referring now to FIG. 6 there is shown a third embodiment of a bail structure 60 according to the present invention which illustrates an alternate form of the bail structure 10 which facilitates moving its handle portion from its storage position to its use position over a chime 61 on a container 62 that projects axially beyond the peripheral surface of the container 62.

Like the bail structure 10, the bail structure 60 comprises a tough, flexible, elongate polymeric strip 63 including an elongate handle portion 64 having two opposite ends 65 and first and second opposite edges 66 and 67 respectively extending between its opposite ends 65, and two anchor portions (not shown) adapted to be bonded as by adhesive to the container 62. The anchor portions are integrally formed with the handle portion 64 with one anchor portion at each of its opposite ends 65, and could have the same structure as the anchor portion 26 or the anchor portion 56, thereby permitting the handle portion 64 to move between a storage position and a use position in the manner of the handle portions 18 and 52 as is described above. Also, the bail structure 60 includes a cover sheet 68 over an adhesive layer on the handle portion 64. Unlike the cover sheet 42 on the handle portion 64, however, the bail structure 60 includes a tab 69 which is part of the cover sheet 68 and is located generally centrally along the length of the handle portion 64. The tab 69 projects generally normally away from the second edge 67 of the handle portion 64 and is adapted to be manually grasped to facilitate moving the handle portion from its storage to its use position extending across the end of the container 62. This tab 69 is particularly useful where the bail structure is used on the type of container 62 shown in FIG. 6 that has a projecting chime 61 rather than a recessed chime that has an outer surface flush with the outer surface of a container as is illustrated in the container 12 of FIGS. 2 and 3. Also the tab 69 provides added reinforcement for the central part of the handle portion 64 which may be desirable, particularly where that central part may be engaged over a narrow hook to support the container 62 to which the bail structure 60 is adhered.

Also, as is illustrated in FIG. 6, the handle portion 64 may have an undulating second edge 67 that produces a central part of the handle 64 portion that has a greater width and cross sectional area than parts of the handle portion 64 between its central part and its end 65. The wider central part provides added reinforcement at the center of the handle portion 64 to restrict its rupture when it is engaged over a hook-like support, and the parts of the handle portion 64 of lesser cross sectional area between its central part and its ends 65 can stretch to absorb any exceptionally high stresses that may be applied to the handle portion 64 to restrict the application of stress at the ends 65 or central part of the handle portion 64 that might otherwise cause their failure.

Referring now to FIGS. 8 and 9 there is shown a fourth embodiment of a bail structure 70 according to the present invention which illustrates an alternate form of the handle portion 18 of the bail structure 10 which allows access under the handle portion in its use position when the bail structure 70 is used on a container 71 having an end that is semispherical in shape.

Like the bail structure 10, the bail structure 70 comprises a tough, flexible, elongate polymeric strip 73 including an elongate handle portion 74 having two opposite ends 75 and first and second opposite edges 76 and 77 respectively extending between its opposite ends 75, and two anchor portions 78 adapted to be bonded as by an adhesive to the container 71. The anchor portions 78 are integrally formed with the handle portion 74 with one anchor portion 78 at each of its opposite ends 75, and could have the same structure as the anchor portion 26 or the anchor portion 56, thereby permitting the handle portion 74 to move between a storage position and a use position in the manner of the handle portions 18 and 52 as is described above. Unlike those handle portions 18 and 52, however, the handle portion 74 has an inner surface length that is longer than the circumference of the container 71 between the locations at which the anchor portions 78 are bonded so that the handle portion 74 will project from the surface of the container 71 in both its storage and use positions to provide access to manually engage the handle portion 74 in its storage position, and to place a hook or other support under the handle portion 74 in its use position.

It should be noted that the anchor portions 78 in the bail structure 70 are not joined as in the other bail structures illustrated, which facilitates forming the bail structure 70. The anchor portions of the other bail structures illustrated need not be joined either, of course, if this would provide any advantage for the manufacture or application of those bail structures.

Referring now to FIGS. 10 and 11, there are illustrated two modifications that can be made to the bail structure 10 to make fifth and sixth embodiments 80 and 90 respectively thereof. Except for the addition of reinforcing members 81 and 91 respectively, the structures of the embodiments 80 and 90 are the same as the structure of the embodiment 10, and the parts thereof described above are similarly mentioned with the addition of the suffix "a" in the embodiment 80, and the suffix "b" in the embodiment 90.

The two elongate reinforcement members 81 in the embodiment 80 bridge from the handle portion 18*a* across its ends 20*a* onto its anchor portions 26*a* and may be useful to provide added strength in this area.

Similarly, the generally circular reinforcement members 91 in the embodiment 80 extend around the openings 27*b* to help reinforce the arcuate terminal ends 25*b* of the second edge 24*b* of the handle portion 18*b* where it joins the anchor portion 26*b*.

Either of the reinforcement members 81 or 91 are made of a tough flexible polymeric material such as those listed above and can be adhered to the outer major surface, but are preferably adhered to the inner major surface of the strip 16*a* or 16*b*.

Referring now to FIG. 12 there is shown a fragment of a seventh embodiment of a bail structure 100 according to the present invention which is not preferred in that its anchor portion 106 does not extend along its handle portion 102, but which has been found suitable for some applications. Like the bail structures described above, the bail structure 100 comprises a tough, flexible, elongate polymeric strip 101 including the elongate handle portion 102 having two opposite ends 103 and first and second opposite edges 104 and 105 respectively extending between its opposite ends 103, with the second edge 105 having arcuate end portions 109 at the ends 103 of the handle portion 102 extending away from the first edge 104 in a direction generally at right angles to the longitudinal direction of the handle portion 102; and two anchor portions 106 adapted to be bonded as by an adhesive to a container. The anchor portions 106 are integrally formed with the handle portion 102 with one anchor portion 106 at each of its opposite ends 103. Each of the anchor portions 106 comprises first and second contiguous parts 107 and 108 shaped so that, when the major surfaces of the handle and anchor portion 102 and 106 are coplanar, the first part 107 projects away from the handle portion 102 in a direction generally aligned with the handle portion 102, and the second part 108 projects away from the first part 107 along and past the adjacent arcuate end portion 109 of the second edge 105 in a direction generally normal to the length of the handle portion 102. The anchor portions 106 can be bonded on opposite sides of a container with the major surfaces of all portions of the strip 101 generally parallel to an axis of the container and with its handle portion 102 in a storage position adjacent an end of the container, and subsequently the handle portion 102 can be moved to a use position extending across the adjacent end of the container, at which use position the handle portion 102 may be used to suspend the container.

Also, as with the other strips described above, the arcuate end portions 109 of the second edge 105 restrict tearing of the strip 101 at the ends of the second edge 105 when the container is suspended by the handle portion 102. In the use position of the handle portion 102, the end portions 109 of the second edge 105 are generally straightened so that they extend axially along the container and away from the handle portion 102 and are then generally parallel with the forces applied through the handle portion 102 to suspend the container so that there is little tendency for a tear to be initiated by the second edge 105.

Having thus described the present invention with reference to several embodiments thereof, it will be appreciated by those skilled in the art that many combinations of the features described in the several embodiments may be used in addition to those described, and that many changes may be made in the structure of the bail structure without departing from the spirit of the present invention. It is contemplated that the bail structure could be used to both bind together and carry a plurality of containers, rather than just a single container as illustrated; or that two or more bail structures could be used on a single container. The statement that the anchor portions can be or are bonded on opposite sides of a container includes positioning them so that a line through the ends of the handle portion will pass approximately through the central axis of the container causing the container to hang with its central axis generally vertically disposed below the handle portion; or, alternatively, positioning them so that a line through the ends of the handle portion will pass through the container on one side of its central axis so that the container will hang with its central axis disposed at an acute angle to the vertical direction, which may be desirable for some purposes and may provide less localized stresses at the ends of the handle portion where a line through the ends of the handle portion is spaced from the axis on the side of the container around which the handle portion extends when it is in its storage position. Also, it is contemplated that a pull structure, such as a length of cardboard which contains advertising or pricing information, may be conveniently inserted between the handle portion and a container when the handle portion is in its storage position to both impart the information printed thereon, and facilitate moving the handle portion to its use position. Thus the scope of the dependent claims should not be limited by the structures of the embodiments described, but only by the structures described in the dependent claims and their equivalents.

We claim:

1. A bail structure adapted to be attached to a container having an axis, said structure comprising:

a tough, flexible, elongate polymeric strip having opposite major surfaces and including an elongate handle portion having two opposite ends and first and second opposite edges extending between said opposite ends, said second edge having arcuate end portions extending away from said first edge in a direction generally at right angles to the longitudinal direction of said handle portion; and two anchor portions adapted to be bonded to a container, said anchor portions being integrally formed with said handle portion with one anchor portion at each of said opposite ends, each of said anchor portions comprising contiguous first and second parts shaped so that, when the major surfaces of said handle and anchor portions are coplanar, said first part projects away from the handle portion in a direction generally aligned with the handle portion and said second part projects away from the first part along and past the adjacent arcuate end portion of the second edge in a direction generally normal to the length of said handle portion, so that said anchor portions can be bonded on opposite sides of a said container with the major surfaces of all portions of the strip generally parallel to the axis of the container and with said handle portion in a storage position adjacent an end of the container, and the handle portion can then be moved to a use position extending across the end of the container at which use position the handle portion may be used to suspend the container and said end portions of said second edge are generally straightened and aligned with stresses applied to the anchor portions through the handle portion.

2. A bail structure according to claim 1 wherein the second parts of said anchor portions each extend around the adjacent arcuate end portion and along the second edge of said handle portion.

3. A bail structure according to claim 2 wherein the second parts of said anchor portions are joined and extend along the entire length of said second edge.

4. A bail structure according to claim 1 or claim 2 further including a layer of pressure-sensitive adhesive on one major surface of said polymeric strip, and a cover sheet overlaying the layer of adhesive on said handle portion.

5. A bail structure according to claim 1 or claim 2 wherein said polymeric strip has a generally circular through opening at each of said opposite ends with the adjacent arcuate end portion defining a portion of said opening.

6. A bail structure according to claim 1 further including reinforcing members adhered to said polymeric strip at the ends of said handle portion.

7. A bail structure according to claim 1 further including a tab generally centrally along the length of said handle portion projecting generally normally away from said second edge and adapted to be grasped to facilitate moving the handle portion to said use position extending across the end of the container.

8. A bail structure according to claim 1 wherein said handle portion includes a central part, and parts between said central part and said ends of lesser cross sectional area than said central part.

9. In combination, a container having an axis; and a bail structure attached to said container, said structure comprising:

a tough, flexible, elongate polymeric strip having opposite major surfaces and including an elongate handle portion having two opposite ends and first and second opposite edges extending between said opposite ends, said second edge having arcuate end portions extending away from said first edge in a direction generally at right angles to the longitudinal direction of said handle portion; and two anchor portions integrally formed with said handle portion with one anchor portion at each of said opposite ends, each of said anchor portions comprising contiguous first and second parts shaped so that, when the major surfaces of said handle and anchor portions are coplanar, said first part projects away from the handle portion in a direction generally aligned with the handle portion and said second part projects away from the first part along and past the adjacent arcuate end portion of the second edge in a direction generally normal to the length of said handle portion, said anchor portions being bonded on opposite sides of said container with the major surfaces of all portions of the strip generally parallel to the axis of the container and with said handle portion in a storage position adjacent an end of the container, said handle portion being moveable to a use position extending across the end of the container at which use position the handle portion may be used to suspend the container and said end portions of said second edge are generally straightened and aligned with stresses applied to the anchor portions through the handle portion.

10. The combination according to claim 9 wherein the second parts of said anchor portions each extend around the adjacent arcuate end portion and along the second edge of said handle portion.

11. A combination according to claim 10 wherein the second parts of said anchor portions are joined and extend along the entire length of said second edge.

12. A combination according to claim 9 or claim 10 wherein a layer of pressure-sensitive adhesive on one major surface of said polymeric strip bonds said anchor portion to said container, and said bail structure includes a cover sheet overlaying the layer of adhesive on said handle portion.

13. A combination according to claim 9 or claim 10 wherein said polymeric strip has a generally circular through opening at each of said opposite ends with the adjacent arcuate end portion defining a portion of said opening.

14. A combination according to claim 9 further including reinforcing members adhered to said polymeric strip at the ends of said handle portion.

15. A combination according to claim 9 wherein said bail structure has a tab generally centrally along the length of said handle portion projecting generally normally away from said second edge and adapted to be grasped to facilitate moving the handle portion to said use position extending across the end of the container.

16. A combination according to claim 9 wherein said handle portion includes a central part, and parts between said central part and said ends of lesser cross sectional area than said central part.

* * * * *

UNITED STATES PATENT AND TRADEMARK OFFICE

CERTIFICATE OF CORRECTION

PATENT NO. : 4,396,128

DATED : August 2, 1983

INVENTOR(S) : Curtis L. Larson and Dee L. Johnson

It is certified that error appears in the above-identified patent and that said Letters Patent is hereby corrected as shown below:

Col. 1, line 22 "or" should read --of--.

Col. 1, line 66 "relative" should read --relating--.

Col. 5, line 54 "59" should read --49--.

Col. 6, line 35 "end" should read --ends--.

Col. 7, line 21, "mentioned" should read --numbered--.

Col. 10, line 31, "the second parts of" should be deleted.

Col. 10, lines 33-34, "the second parts of" should be deleted.

Col. 10, line 40, "portion" should read --portions--.

Signed and Sealed this

*Sixteenth* Day of *July 1985*

[SEAL]

*Attest:*

DONALD J. QUIGG

*Attesting Officer*

*Acting Commissioner of Patents and Trademarks*